US005950372A

United States Patent [19]

Al-Sabah et al.

[11] Patent Number: 5,950,372

[45] Date of Patent: Sep. 14, 1999

[54] SHELTERING APPARATUS AND METHOD OF SHELTERING SAME

[75] Inventors: Sabah Naser Al-Sabah, Al-Ras, Kuwait; Peter Wusthof, Lohr; Erich Wirzberger, Nevhutten, both of Germany

[73] Assignee: International Design Systems Company, Sufat, Kuwait

[21] Appl. No.: 08/814,425

[22] Filed: Mar. 10, 1997

[51] Int. Cl.[6] ..... E04B 1/344; F41F 3/04

[52] U.S. Cl. ..... 52/66; 52/67; 89/1.8

[58] Field of Search ..... 52/66, 67, 169.6; 89/1.8, 1.802, 1.804

[56] References Cited

U.S. PATENT DOCUMENTS

| | | | |
|---|---|---|---|
| 1,058,169 | 4/1913 | Fischer . | |
| 1,396,489 | 11/1921 | Williams . | |
| 2,532,830 | 12/1950 | Barnhart et al. | 52/66 |
| 2,729,966 | 1/1956 | Lutteke | 52/169.6 X |
| 2,975,676 | 3/1961 | Butler . | |
| 2,985,072 | 5/1961 | Carlberg et al. | 89/1.802 |
| 3,162,088 | 12/1964 | Landstrom | 89/1.802 |
| 3,316,809 | 5/1967 | Riedel . | |
| 3,352,596 | 11/1967 | Escoto . | |
| 3,861,271 | 1/1975 | Osborn, Jr. . | |
| 4,255,911 | 3/1981 | Beacom et al. . | |
| 4,681,013 | 7/1987 | Farley et al. . | |

FOREIGN PATENT DOCUMENTS

| | | |
|---|---|---|
| 0 039 290 | 3/1990 | European Pat. Off. . |
| 378 787 | 10/1907 | France . |
| 459 348 | 11/1913 | France . |
| 1207832 | 12/1965 | Germany . |
| 909083 | 3/1980 | Russian Federation . |
| 118 669 | 10/1918 | United Kingdom . |

OTHER PUBLICATIONS

S. Ereyer: "das sowjetische "SA–N–4" Schiff/Luft–Fk–Waffensystem" SOLDAT UND TECHNIK., vol. 16, No. 11, Nov. 1973, Frankfurt am Main Germany pp. 610–611, XPOO20500348.

DE 12 07 832 (BÖLKOW) Dec. 23, 1965 (whole document).

*Primary Examiner*—Christopher Todd Kent

*Attorney, Agent, or Firm*—Allen, Dyer, Doppelt, Milbrath & Gilchrist, P.A.

[57] ABSTRACT

An apparatus and methods are provided for sheltering and/or launching devices such as projectiles or a tracking device. The apparatus preferably includes a main body having a bottom, a plurality of walls connected to and extending upwardly from the bottom, and an inner chamber defined by the inner confines of the bottom and the plurality of walls. An inner chamber cover is connected to the main body for covering the inner chamber of the main body when in a closed position and for accessing the inner chamber when in an open position. A sheltered device mount preferably is positioned in the inner chamber and connected to the main body for mounting a device to be sheltered thereto. A sheltered device mount extender and retractor is connected to the sheltered device mount for extending the sheltered device mount upwardly from the bottom simultaneous with the opening of the inner chamber cover to thereby position the sheltered device mount for operational use and retracting the sheltered device mount downwardly toward the bottom simultaneous with the closing of the inner chamber cover to thereby position the sheltered device mount for sheltering.

57 Claims, 8 Drawing Sheets

SHELTERING APPARATUS AND METHOD OF SHELTERING SAME

FIELD OF THE INVENTION

The present invention relates to the field of sheltering systems and, more particularly, to an apparatus and method for sheltering devices such as projectiles, weapons, tracking devices, or various personnel.

BACKGROUND OF THE INVENTION

Over the years, various airship-type shelters have been developed which shelter balloon-type airships prior to release for launching. These shelters simply open a cover to release the balloon-type airship upwardly for launching from the shelter. An example of such a system can be seen in U.S. Pat. No. 1,058,169 by Fischer. These shelters have also been developed for helicopter type airships. An example of this type of shelter can be seen in U.S. Pat. No. 4,255,911 by Beacom, deceased et al.

These conventional sheltering systems, however, are often not effective for high speed projectile sheltering and launching such as of missiles or other military weapons. These conventional sheltering systems also fail to provide effective control of timing for when a sheltered device should be exposed for operational use or sheltered for protection or hiding from view. These conventional shelters further fail to provide sheltering for quick and repetitive operational use of the sheltering apparatus.

SUMMARY OF THE INVENTION

With the foregoing in mind, the present invention advantageously provides an apparatus and methods for sheltering devices for quick and repetitive operational use. An apparatus and methods also advantageously provide effective control of operational timing for opening and closing the sheltering apparatus such as for launching projectiles or operating a radar tracking device. An apparatus and methods according to the present invention additionally provide effective operational control of the positioning of the projectiles, weapons, or tracking devices which are mounted within an inner chamber of the sheltering apparatus for launching or movement required by the operational use desired. An apparatus and methods according to the present invention further provide a small footprint for a sheltering apparatus that can effectively be hidden from ready exposure by surveillance systems and yet provide effective sheltering and/or projectile launching capabilities.

The present invention, more particularly, advantageously provides a sheltering apparatus which preferably includes a main body having a bottom, a plurality of walls connected to and extending upwardly from said bottom, and an inner chamber defined by the inner confines of the bottom and the plurality of walls. Inner chamber covering and accessing means is connected to the main body for covering the inner chamber of the main body when in a closed position and for accessing the inner chamber when in an open position. Sheltered device mounting means preferably is positioned in the inner chamber and connected to the main body for mounting a device to be sheltered thereto. Sheltered device mount extending and retracting means is connected to the sheltered device mounting means for extending the sheltered device mounting means upwardly from the bottom simultaneous with the opening of the inner chamber covering and accessing means to thereby position the sheltered device mounting means for operational use and retracting the sheltered device mounting means downwardly toward the bottom simultaneous with the closing of the inner chamber covering and accessing means to thereby position the sheltered device mounting means for sheltering devices mounted thereto.

The sheltered device mount, for example, can be a platform that raises and lowers responsive to the opening and closing of a cover for the main body so that the positioning of the sheltered device outside of the main body for operational use, i.e., launching projectiles, tracking aircraft, quickly occurs. This apparatus can therefore provide increased timing and accuracy advantages when applied to security or military situations. The opening and closing of a pair of cover members which form the cover of the main body and the corresponding raising and lowering of the sheltered device mount, e.g., a platform, preferably simultaneously occurs. This simultaneous movement whereby the opening of the pair of cover members corresponds to the raising of the sheltered device mount and the closing of the pair of cover members corresponds to the lowering of the sheltered device mount preferably simulates the opening and closing of fingers of a pair of hands positioned finger-tip to finger-tip with the raising and lower of thumbs positioned thumb-tip to thumb-tip as illustrated in FIGS. 3–4. The inner chamber therefore can correspond to the inner chamber formed by the closing of the pair of hands. Such a configuration provides a smooth and fluid motion of the opening and closing of the cover and the raising and lowering of the sheltered devices, e.g., projectiles, missiles, weapons, tracking devices, and/or military personnel.

A sheltering apparatus which has the capability of launching projectiles therefrom according to the present invention preferably includes a main body having a bottom, a plurality of walls connected to and extending upwardly from the bottom, and an inner chamber defined by the inner confines of the bottom and the plurality of walls. Inner chamber covering and accessing means is connected to the main body for covering the inner chamber of the main body when in a closed position and for accessing the inner chamber when in an open position. Projectile mounting means is positioned in the inner chamber and connected to the main body for mounting at least one projectile thereto. Projectile mount extending and retracting means is connected to the projectile mounting means for extending the projectile mounting means upwardly from the bottom responsive to the opening of the inner chamber covering and accessing means to thereby position the projectile mounting means for launching and retracting the projectile mounting means downwardly toward the bottom responsive to the closing of the inner chamber covering and accessing means to thereby position the projectile mounting means for sheltering the at least one projectile mounted thereto.

The present invention also includes methods of sheltering devices. A method according to the present invention preferably includes opening an inner chamber cover which covers an inner chamber of a main body and upwardly extending a sheltered device positioned within the inner chamber of the main body simultaneously with the opening of the inner chamber cover to thereby position the sheltered device for operational use.

Another method of sheltering devices according to the present invention preferably includes providing a main body having a bottom, a plurality of walls connected to and extending upwardly from the bottom, and an inner chamber defined by the inner confines of the bottom and the plurality of walls and providing a pair of inner chamber cover members connected to the main body to cover the inner chamber of the main body when in a closed position and to access the inner chamber when in an open position. A device to be sheltered is mounted to a sheltered device mount positioned within the inner chamber when the pair of inner chamber cover members are in the closed position. The sheltered device mount is extended upwardly from the bottom simultaneous with the opening of the pair of inner chamber cover members to thereby position the sheltered device mount for operational use. The sheltered device mount is also retracted downwardly toward the bottom simultaneous with the closing of the pair of inner chamber cover members to thereby position the sheltered device mount for sheltering of the device mounted thereto.

A further method of sheltering devices according to the present invention preferably includes opening a pair of inner chamber cover members which cover an inner chamber of a main body and upwardly extending a sheltered device mount positioned within the inner chamber of the main body simultaneous with and responsive to the opening of the pair of inner chamber cover members to thereby position the sheltered device mount for operational use. The pair of inner chamber cover members are also closed, and the sheltered device mount is downwardly retracted simultaneous with and responsive to the closing of the pair of inner chamber cover members to thereby position the sheltered device mount for sheltering of the device mounted thereto.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION

The present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art. Like numbers refer to like elements throughout, and prime and double prime notation are used to indicate similar elements in alternative embodiments.

Figure 1:
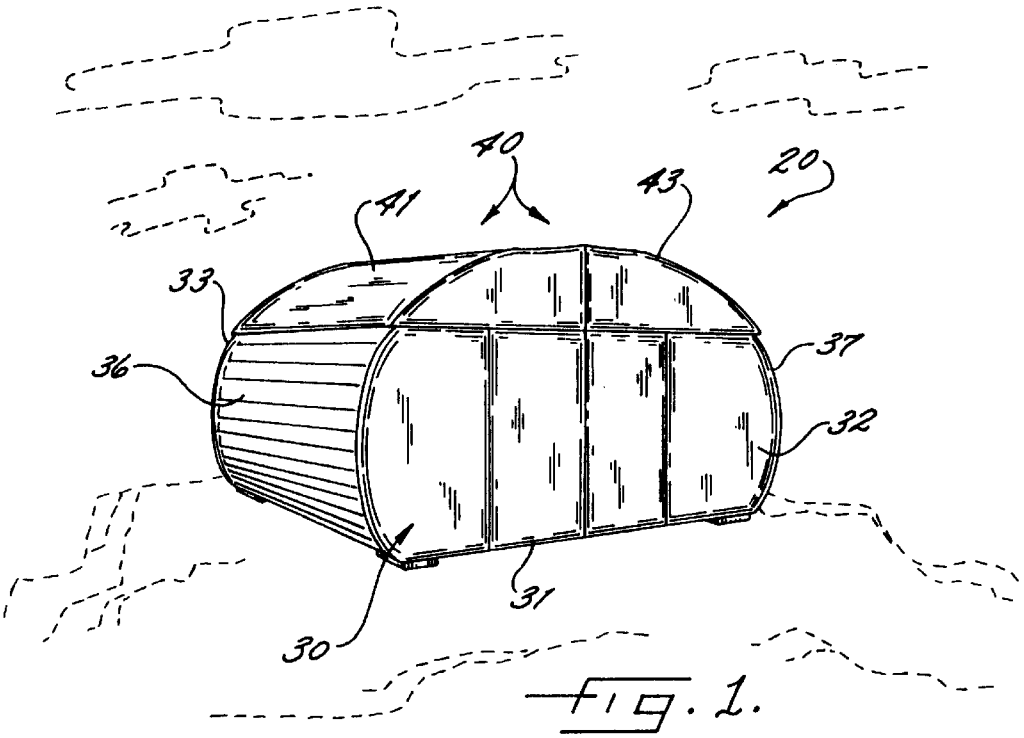
FIG. 1 is a perspective environmental view of a sheltering apparatus in a closed and sheltering position according to a first embodiment of the present invention.
Figure 2:
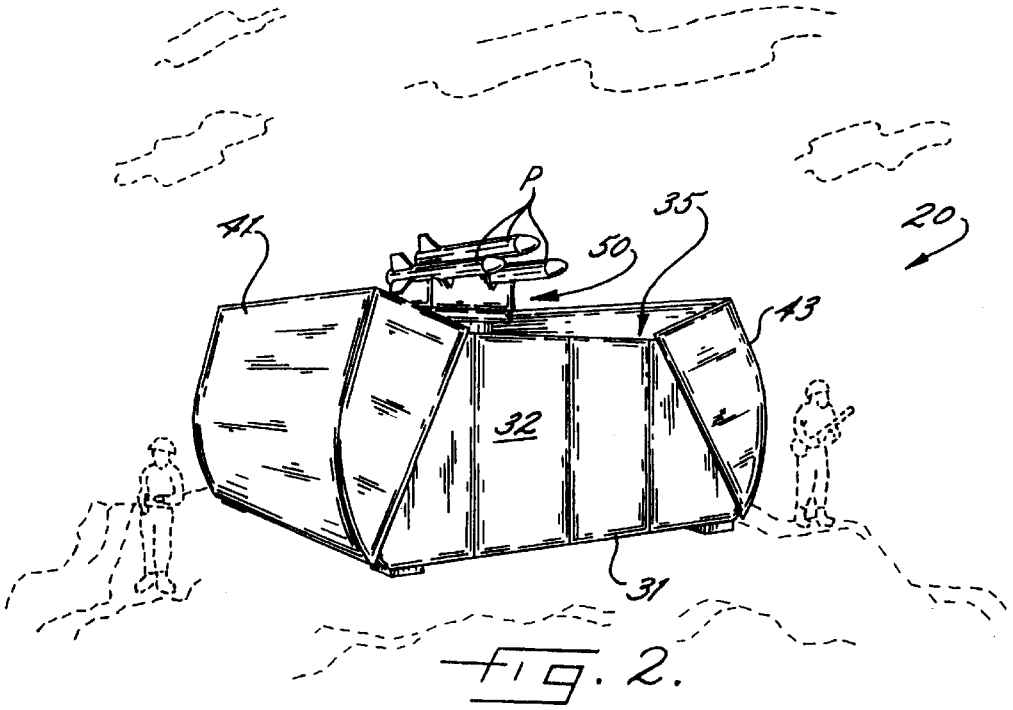
FIG. 2 is a perspective environmental view of a sheltering apparatus in an open and launching position according to a first embodiment of the present invention.

FIGS. 1–2 illustrate an apparatus 20 and methods for sheltering devices P such as projectiles, weapons, tracking devices, or even hidden military personnel, according to a first embodiment of the present invention. The sheltering apparatus 20 preferably includes a main body 30 having a bottom 31, a plurality of walls 32, 33, 36, 37 connected to and extending upwardly from the bottom 31, and an inner chamber 35 defined by the inner confines of the bottom 31 and the plurality of walls 32, 33, 36, 37. The bottom 31 is preferably mounted on a plurality of feet, rails, or other structural support members which support the bottom 31 as well as other portions of the apparatus 20. The plurality of walls 32, 33, 36, 37 preferably includes at least a front wall 32 and a rear wall 33, but also can include a pair of side walls 36, 37 connected to the bottom 31 and front and rear walls 32, 33 such as illustrated. The front and rear walls 32, 33 have a relatively flat outer surface, and the side walls 36, 37 according to this embodiment of the apparatus 20 have an arcuate shape so that the entire sheltering apparatus 20 has a generally oblong shape as illustrated. The front and rear walls 32, 33 can also be formed of a plurality of wall panels that also can be opened or closed to provide access to the inner chamber 35 or other portions of the apparatus 20 such as for mechanical maintenance, loading/unloading, or mounting arrangements wherein a plurality of these shelters are connected together.

The apparatus 20 is illustrated as being positioned above ground, but it will be understood by those skilled in the art that major portions of the sheltering apparatus 20 according to the present invention can also be buried underground, e.g., hidden, so that only upper peripheries of the apparatus 20 are positioned for opening, closing, accessing, and/or releasing devices positioned therein. These arrangements of the apparatus 20 in various environmental conditions allows the apparatus 20 to be used in various military, security, commercial aviation, or other environments where the advantages of the present invention are desired.

The apparatus 20 also has inner chamber covering and accessing means 40 connected to the main body 30 for covering the inner chamber 35 of the main body 30 when in a closed position and for accessing the inner chamber 35 when in an open position. The inner chamber covering and accessing means 40 preferably is a cover which includes a pair of cover members 41, 43 connected to the main body 30 for covering and for accessing the upper end of the inner chamber 35. The inner chamber covering and accessing means 40 also preferably includes cover extending and retracting means 45, e.g., a cover extender and retractor, connected to the pair of cover members 41, 43 and/or connected to the main body 30, for extending each of the pair of cover members 41, 45 outwardly and downwardly to the open position and for retracting each of the pair of cover members 41, 43 upwardly and inwardly to the closed position. As understood by those skilled in the art, the cover extender and retractor 45 can be a hydraulic system, a gas pressurized system, an electronic system, and/or other mechanical systems which, for example, can include motors, pulleys, cables, or cams that smoothly and efficiently opens and closes the inner chamber cover (see also FIGS. 7–12).

Each of the pair of cover members 41, 43 of the apparatus 20 of this first embodiment advantageously has a generally arcuate shape as illustrated. The upper ends of each of the pair of cover members 41, 43 are positioned adjacent each other when in the closed position covering the inner chamber 35. The lower ends of each of the pair of cover members 41, 43 extend below upper ends of the front and rear walls 32, 33 when the pair of cover members 41, 43 is in the closed position. The outer surfaces of the side walls 46, 47 also can advantageously have a plurality of tracks for providing ease of movement or a more controlled guide path for the cover members 41, 43 during the extending and retracting thereof.

Sheltered device mounting means 50, e.g., a sheltered device mount, preferably is positioned in the inner chamber 35 and connected to the main body 30 for mounting a device P to be sheltered thereto. Sheltered device mount extending and retracting means 55, e.g., a sheltered device extender and retractor, is connected to the sheltered device mounting means 50 for extending the sheltered device mounting means 50 upwardly from the bottom 51 simultaneous with the opening of the inner chamber covering and accessing means 40 to thereby position the sheltered device mounting means 50 for operational use and retracting the sheltered device mounting means 50 downwardly toward the bottom 31 simultaneous with the closing of the inner chamber covering and accessing means 40 to thereby position the sheltered device mounting means 50 for sheltering device(s) P mounted thereto. As understood by those skilled in the art, the sheltered device extender and retractor 55 also can be a hydraulic system, a gas pressurized system, an electronic system, and/or other mechanical systems which, for example, can include motors, pulleys, cables, or cams that smoothly and efficiently raises and lowers the sheltered device mounting means 50 (see also FIGS. 7–12).

Figure 4:
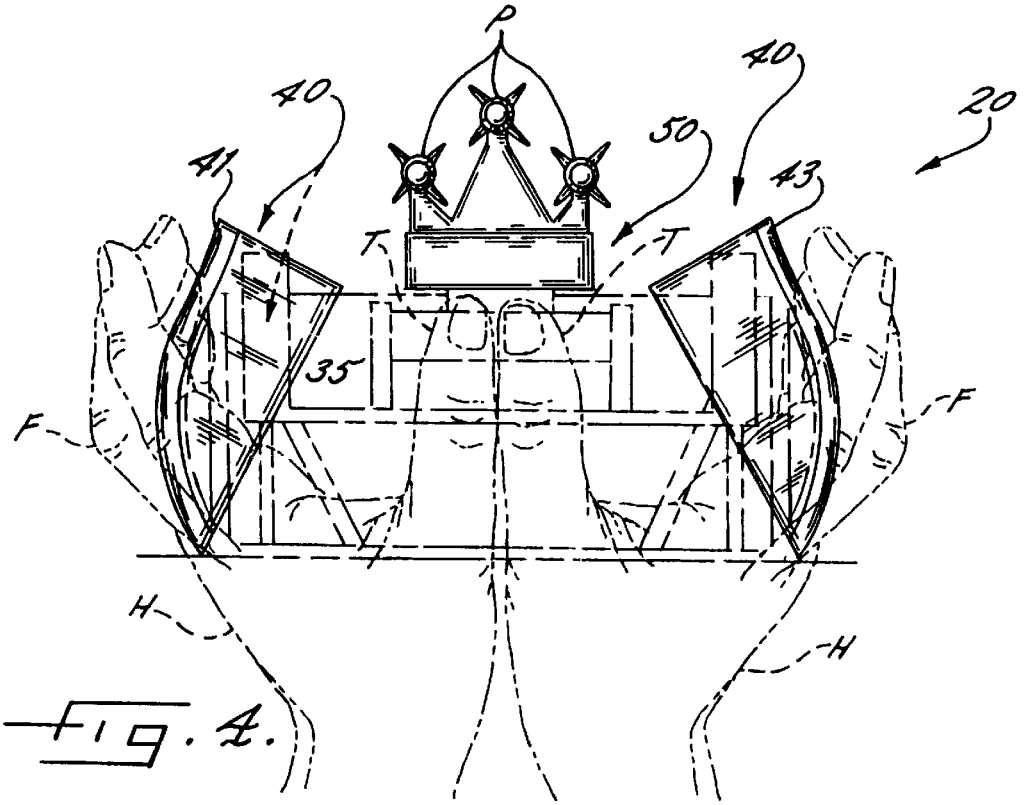
FIG. 4 is a fragmentary front elevational view of a sheltering apparatus having a pair of hands in an open and launching position in phantom view according to a first embodiment of the present invention.

As best illustrated in FIGS. 2 and 4, the sheltered device mount extending and retracting means 55 advantageously extends the sheltered device mounting means 50 upwardly above upper peripheries of each of the pair of cover members 41, 43 to the operational use position when the pair of cover members 41, 43 is in the open position. This positional extension of the sheltered device mounting means 50 advantageously allows the sheltered devices P, e.g., projectiles, missiles, weapons, radar trackers (see FIG. 6), and/or security or military personnel, to have clearance from the pair of cover members 41, 43 when operationally using the sheltered device(s) P. Examples of such uses can be launching missiles (see FIG. 5), tracking military aircraft (see FIG. 6), or a combination of these and other uses as understood by those skilled in the art.

As described above, and as best illustrated in FIGS. 3–5, the cover extending and retracting means 45 according to this first embodiment of the sheltering apparatus 20 preferably extends each of the pair of cover members 41, 43 outwardly and downwardly in a generally arcuately-shaped path (see arrows in FIG. 5) and extends and retracts the sheltered device mounting means 50 upwardly from the bottom 31 of the main body 30 along a generally vertical path through the open pair of cover members 41, 43. The cover extending and retracting means 45 also likewise advantageously retracts the sheltered device mounting means 50 downwardly through the pair of cover members 41, 43 during the closing process.

Figure 5:
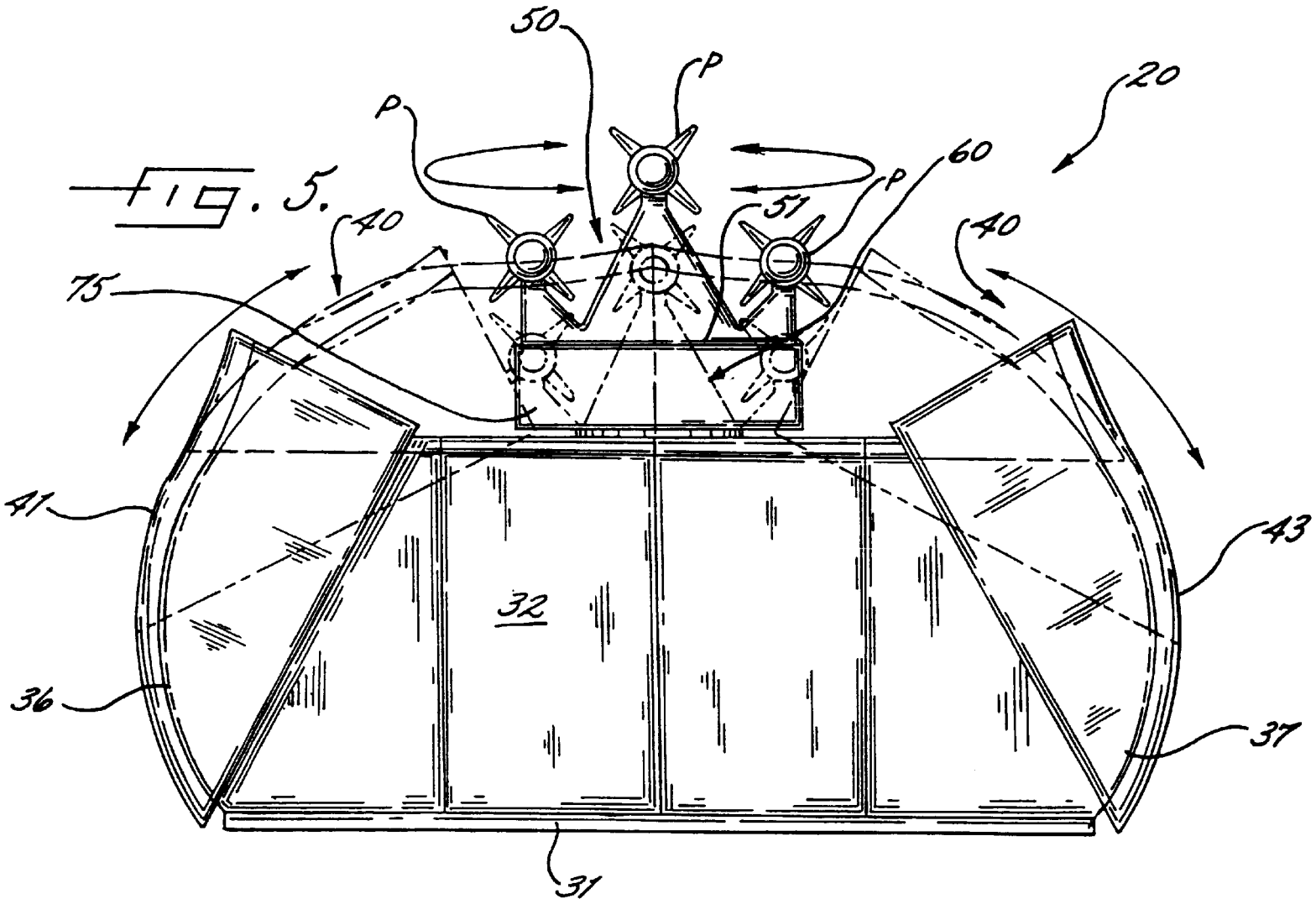
FIG. 5 is a front elevational view of a sheltering apparatus which illustrates the upward/downward movement of the platform, the upward/downward movement of the pair of cover members, and the rotational movement of the projectiles mounted on the platform according to a first embodiment of the present invention.
Figure 6:
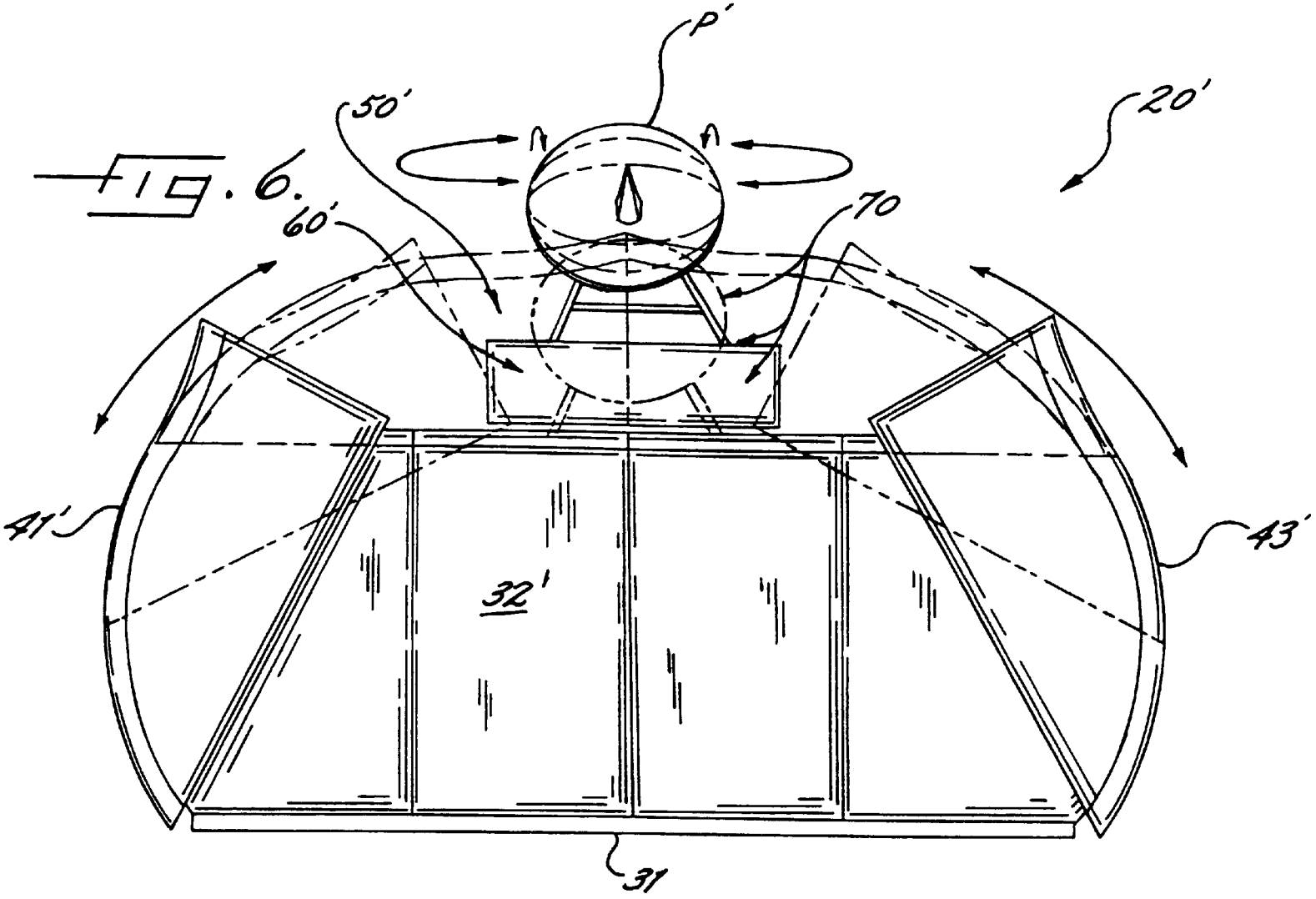
FIG. 6 is a front elevational view of a sheltering apparatus having a tracking device mounted therein according to a second embodiment of the present invention.

As best illustrated in FIGS. 5–6, sheltered device positioning means 60 preferably is connected to the sheltered device mounting means 50 for positioning the sheltered device P for operational use. The sheltered device positioning means 60 preferably includes rotating means 62, e.g., a rotator, connected to the sheltered device mounting means 50 for rotating the sheltered device mounting means 50 or the sheltered device(s) P to a selected position, e.g., also illustrated by the arrows. The sheltered device positioning means 60 preferably also includes tilting means 66, e.g., a tilter, connected to the sheltered device mounting means 50 for tilting the sheltered device mounting means 50 or the sheltered device(s) P to a selected position for operational use thereof (see, e.g., FIG. 6).

Figure 9:
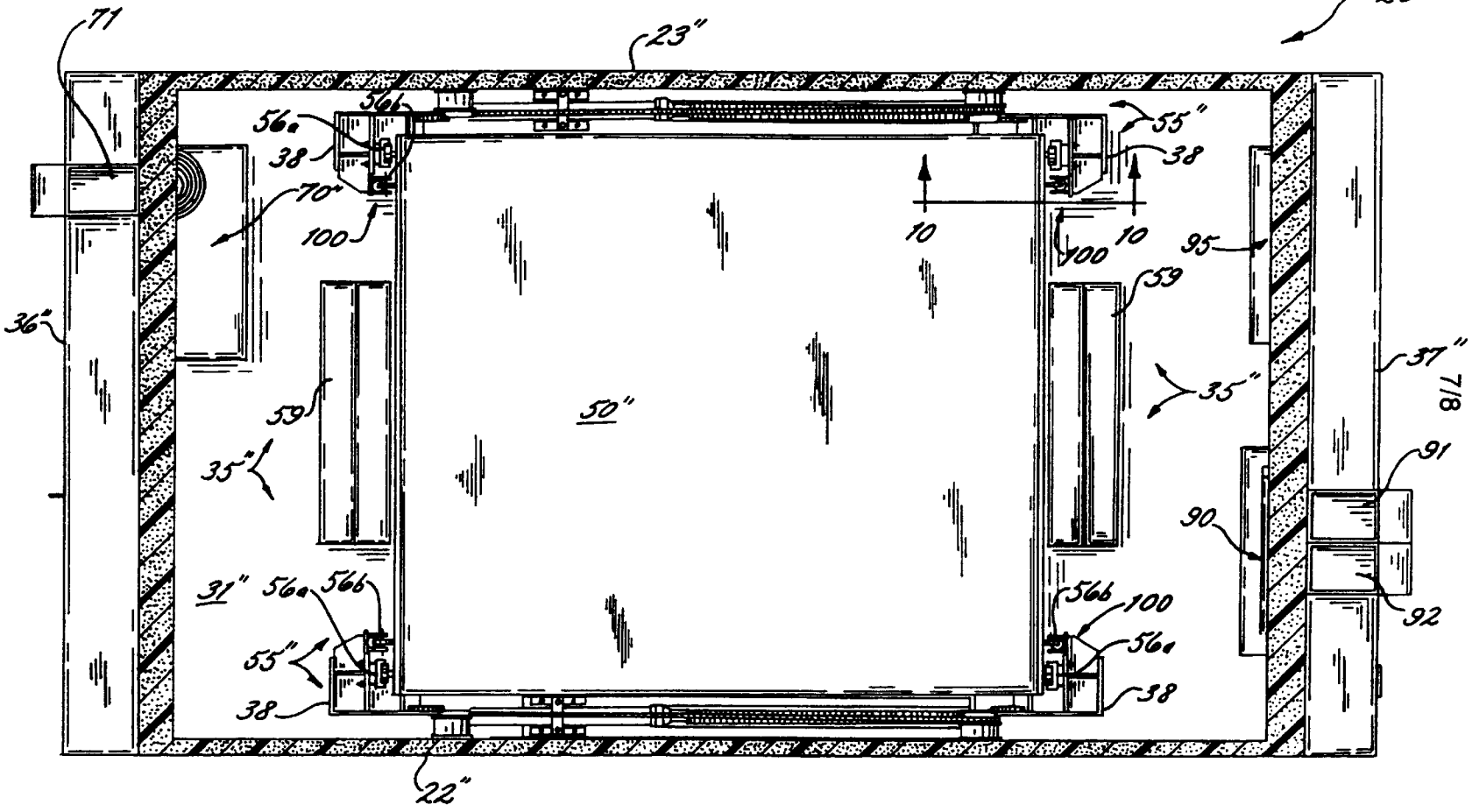
FIG. 9 is sectional view of a sheltering apparatus taken along line 9—9 of FIG. 8 according to a third embodiment of the present invention.

Because, for example, the sheltering apparatus 20 can be positioned in desert, humid, ice, extremely hot, and/or extremely cold environments for various uses, the apparatus 20 can further include temperature controlling means 70, e.g., a temperature controller such as an air conditioner and/or heater, connected to the main body 30 for controlling the temperature of the inner chamber 35 of the main body 30 during these various environmental conditions. This temperature controller 70 as understood by those skilled in the art can advantageously inhibit damage to the shelter mount extending and retracting means 55, the cover extending and retracting means 45, the projectiles, tracking device(s), military personnel, or other contents of the inner chamber 35 (see, e.g., as best illustrated in FIG. 9).

Remote command signal sensing means 75, e.g., a sensor, can also be connected to the main body 30 for sensing a predetermined command signal transmitted from a source remote to the main body 30 to thereby responsively open and close the inner chamber covering and accessing means 40. As understood by those skilled in the art, this sensing means 75 can also be used to control the sheltered device positioning means 60 as well. The remote command signal sensor 75 can provide communications between a base station or control center which, for example, can activate the opening and closing of the cover members 41, 43 when a selected use is desired.

A sheltering apparatus 20 according to a preferred embodiment of the present invention is illustrated in FIGS. 1–5 and preferably has the capability of launching projectiles P therefrom. The apparatus 20 according to the present invention preferably includes projectile mounting means as the sheltered device mount 50 and is positioned in the inner chamber 35 and connected to the main body 30 for mounting a plurality of missile-type projectiles P thereto. This particular projectile mounting means 50 advantageously includes a multi-level projectile platform 51 that allows the plurality of projectiles P to be positioned in a space-apart arrangement for separate or simultaneous launching. This multi-level platform, for example, inhibits interference or damage caused by adjacent projectiles during the launching process. The sheltered device mount extending and retracting means 55 preferably is projectile mount extending and retracting means which is connected to the projectile mounting means 50 for extending the projectile mounting means upwardly from the bottom 31 responsive to the opening of the inner chamber covering and accessing means 40 to thereby position the projectile mounting means 50 for launching and retracting the projectile mounting means 50 downwardly toward the bottom 31 responsive to the closing of the inner chamber covering and accessing means 40 to thereby position the projectile mounting means 50 for sheltering the plurality of projectiles P mounted thereto.

Figure 3:
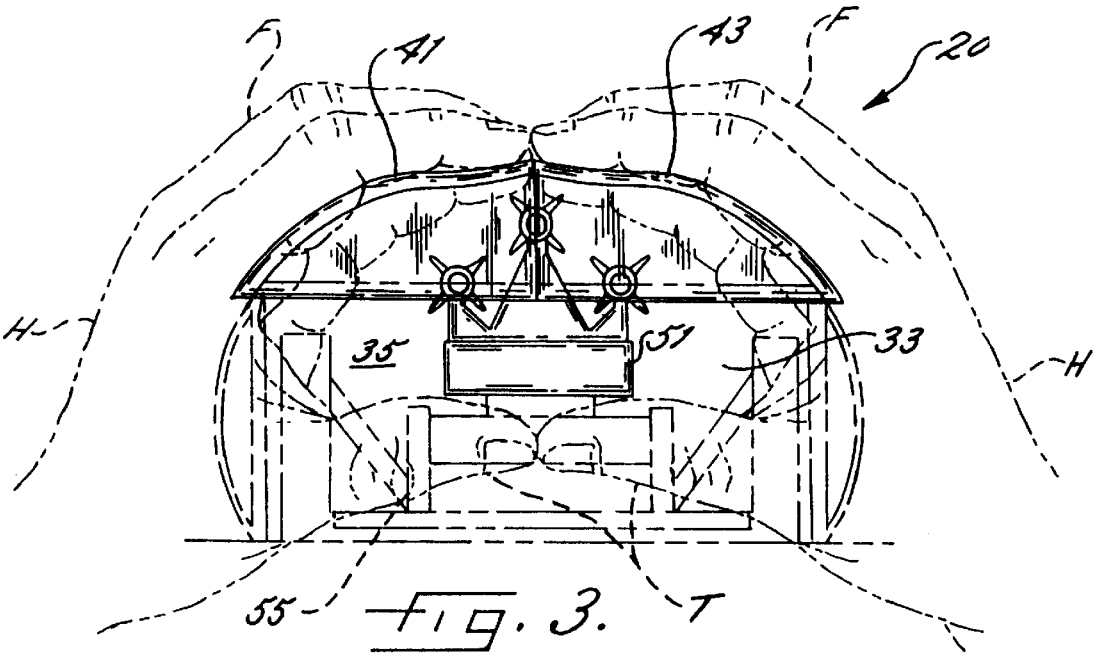
FIG. 3 is a fragmentary front elevational view of a sheltering apparatus having a pair of hands in a closed and sheltering position in phantom view according to a first embodiment of the present invention.
Figure 7:
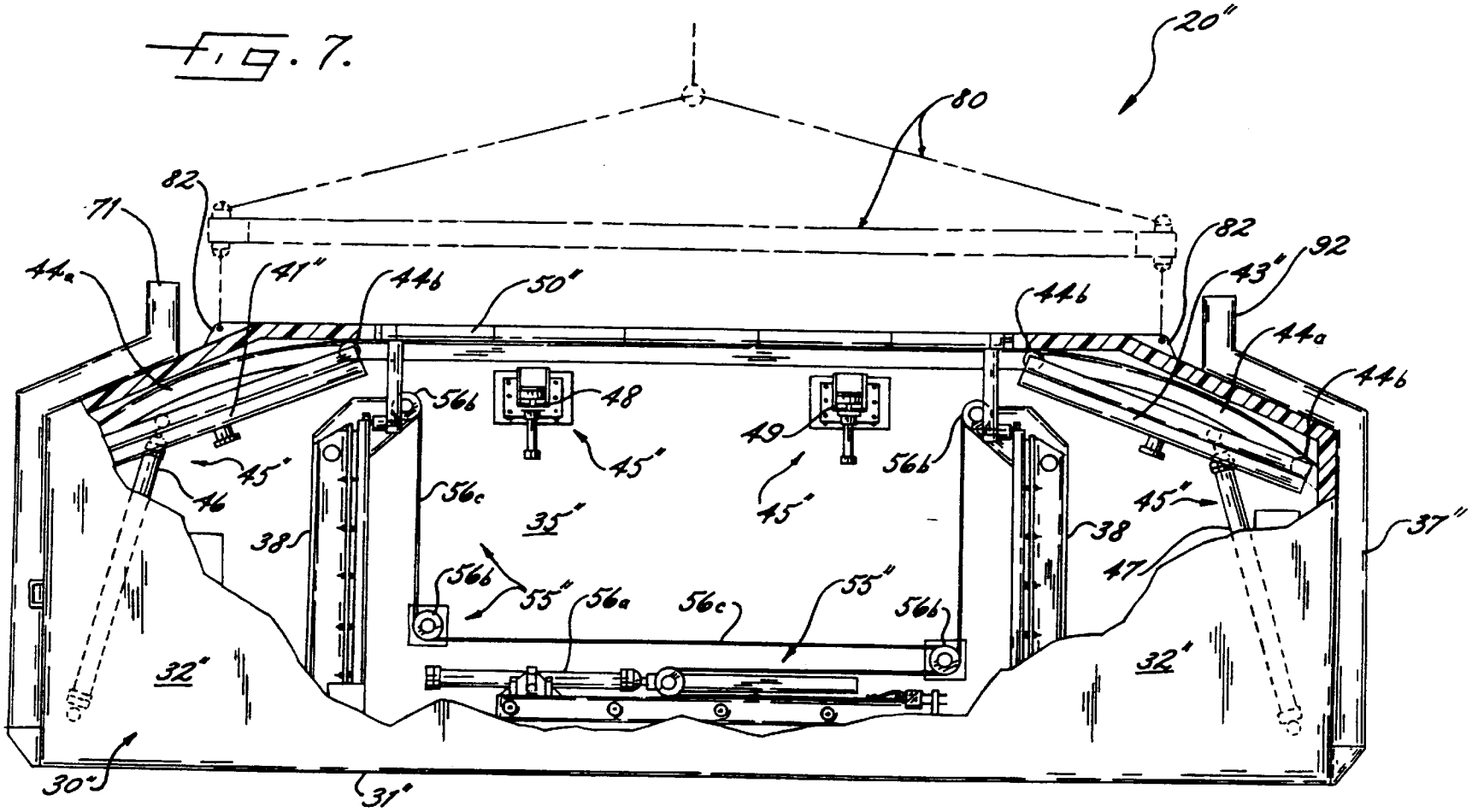
FIG. 7 is a front elevational view of a sheltering apparatus having a sheltered device mount thereof in an extended position and having portions thereof broken away for clarity according to a third embodiment of the present invention.
Figure 8:
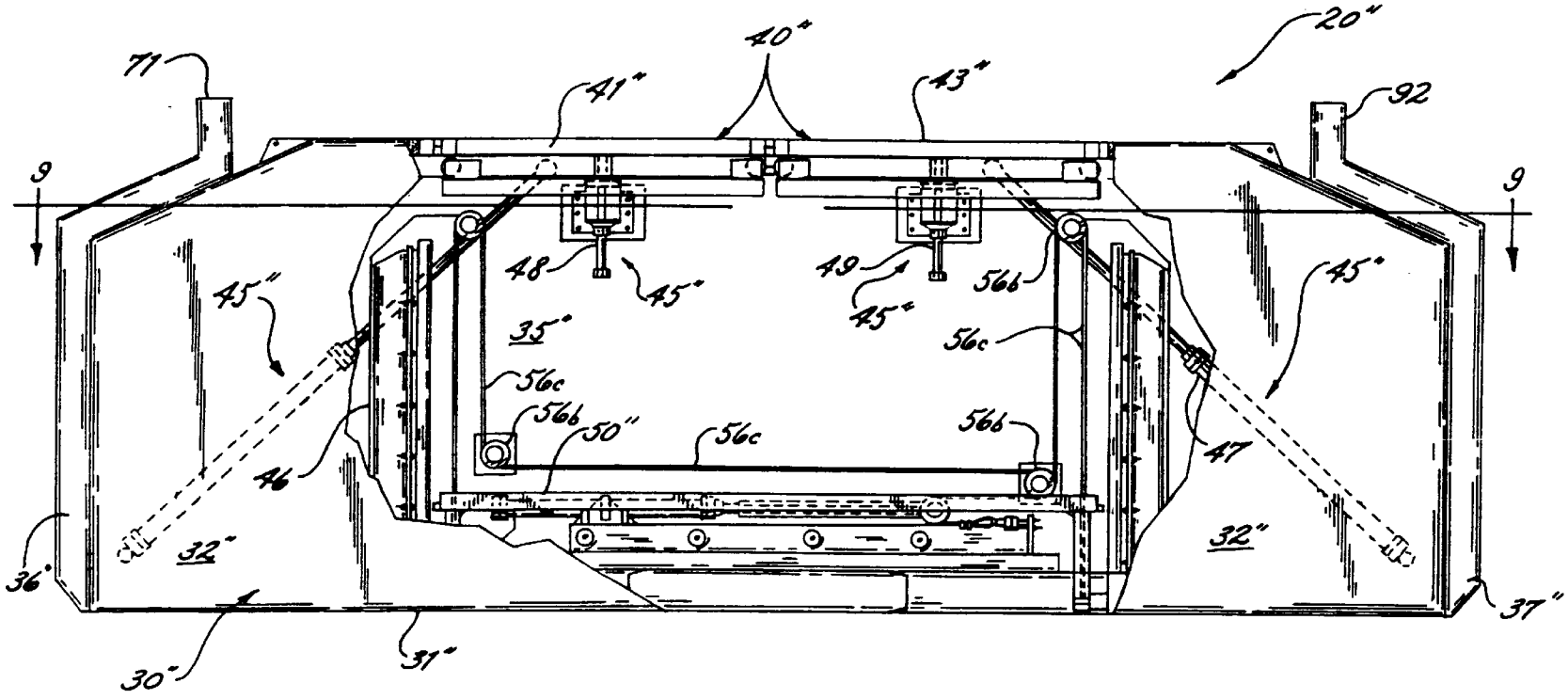
FIG. 8 is a front elevational view of a sheltering apparatus having a sheltered device mount thereof in a retracted position and having portions thereof broken away for clarity according to a third embodiment of the present invention.

As best illustrated in FIGS. 3–4, as well as FIGS. 7–8, the sheltered device mount 50, for example, advantageously can be a platform 51 that raises and lowers responsive to the opening and closing of a cover 41, 43 for the main body 30 so that the positioning of the sheltered device P outside of the main body 30 for operational use, i.e., launching projectiles, tracking aircraft, quickly occurs. It will also be understood by those skilled in the art that other types of a sheltered device mount 50 can be used as well according to the present invention. This apparatus 20 can therefore provide increased timing and accuracy advantages when applied to security or military situations.

The opening and closing of the pair of cover members 41, 43 which form the cover of the main body 30 and the corresponding raising and lowering of the sheltered device mount 50, e.g., a platform 51, preferably simultaneously occurs. Advantageously, this simultaneous movement whereby the opening of the pair of cover members 41, 43 corresponds to the raising of the sheltered device mount 50 and the closing of the pair of cover members 41, 43 corresponds to the lowering of the sheltered device mount 50 preferably simulates the opening and closing of fingers F of a pair of hands H positioned finger-tip to finger-tip with the raising and lower of thumbs T positioned thumb-tip to thumb-tip as illustrated in FIGS. 3–4. The inner chamber 35 therefore can correspond to the inner chamber formed by the closing of the pair of hands H. Such a configuration provides a smooth and fluid motion of the opening and closing of the cover members 41, 43 and the raising and lowering of the sheltered devices P, e.g., projectiles, missiles, weapons, and/or tracking devices (see FIGS. 5–6). The sheltering apparatus 20, for example, can also be advantageously used to hide security or military personnel which can readily exit or retreat to the sheltering apparatus 20 during various security and military needs (e.g., see access door 39 shown in FIG. 12 for access the inner chamber 35, 35', 35")).

FIGS. 7–12 illustrate yet another embodiment of a sheltering apparatus 20" according to the present invention. This embodiment of the sheltering apparatus 20" has a generally rectangular shape and preferably includes insulation material, such as polyurethane foam, positioned within the front, rear, and side walls 32", 33", 36", 37" of the main body 30" (see, e.g., FIG. 9). The sheltering apparatus 20" also includes a power generator 90, e.g., a diesel power generator, for generating power for the temperature controller 70" and other devices needing power. The power generator 90 also has intake and/or exhaust pipes 91, 92 for intaking fresh air into the inner chamber 35" and for discharging or exhausting air or gas outside of the inner chamber 35". As illustrated, the temperature controller 70" also has an intake pipe 71 as well.

This third embodiment also illustrates in more detail the extending and retracting means 55" of a sheltered device mount 50", e.g., a platform, and the extending and retracting means 45" of a pair of cover members 41", 43" of a sheltering apparatus 20" according to the present invention. Also, according to this third embodiment, the pair of cover member 41", 43" retract into the inner confines of the main body 30" of the sheltering apparatus 20" instead of retracting outside of the inner confines of the main body 30" of the sheltering apparatus 20, 20' of the first and second embodiments of the present invention. Nevertheless, the covering means 40" of this embodiment advantageously includes cover extending and retracting tracks 44*a* connected to the main body 30" and track followers 44*b*, e.g., rollers or wheels, connected to each of the pair of cover members 41", 43" for following the tracks 44*a*. The cover extending and retracting tracks 44*a*, as best illustrated in FIG. 7, preferably have a generally arcuate shape for transporting the pair of cover members 41", 43" along an arcuate extending and retracting path.

FIG. 7 also illustrates in phantom view means for lifting 80 the sheltering apparatus 20" to position the apparatus 20" in a desired location by the use of a boom, an aircraft, or other lifting device. The lifting means 80 preferably includes a pair of lift mounts 82 connected to an upper portion of the main body 30" for connecting a lifting arm or the like thereto as illustrated. It will be understood by those skilled in the art that other lifting means 80 and locations of lifting means 80, such as wheeled transports for lifting the bottom 31" of the main body 30", can be used as well according to the present invention.

FIGS. 7–9 and 11–12 particularly illustrate an operational structure which allows the simultaneous raising or extending the platform 50" and lowering or retracting of the platform 50" with the respective opening or extending and closing or retracting of the covering means 40", e.g., a pair of cover members 41", 43". FIGS. 7–9 illustrate an embodiment of shelter mount extending and retracting means 55", e.g., a shelter mount extender and retractor, in the form of hydraulic cylinders 57*a*, pulleys 57*b*, and cables 57*c* positioned to raise and lower the shelter mount or platform 50". The sheltering apparatus 20" of this embodiment also has a hydraulic controlling means 95, e.g., a hydraulic power unit, positioned within the inner chamber 35" and in operational communication with the shelter mount extending and retracting means 55" and the cover extending and retracting means 45" for operationally controlling the hydraulic operations of the shelter mount extending and retracting means 55" as well as the cover extending and retracting means 45".

The shelter mount extending and retracting means 55", for example, in this embodiment preferably has a plurality of hydraulic cylinders 57*a*, a plurality of pulleys 57*b*, and a plurality of cables 57*c* which operate to raise and lower the shelter mount or platform 50" along a plurality of tracks or guides 56*a*. The platform 50" has a plurality of corresponding track followers 56*b*, e.g., wheels or rollers, which follow the track 56*a* during raising and lowering of the platform 50" by the hydraulic cylinders 57*a*, pulleys 57*b*, and cables 57*c*. Additionally, for accessing and/or loading the platform 50, stairs 59 can also be positioned within the inner chamber 35" adjacent the platform 50" such as illustrated.

The cover extending and retracting means 45", for example, preferably has at least a pair of hydraulic cylinders 46, 47 each connected to the inner confines of the main body 30" and respectively to the pair of cover members 41", 43" as illustrated. The cover extending and retracting means 45" of this embodiment also includes a pair of cover lifters and/or locks 48, 49, e.g., cover closing cylinders, connected to an upper portion of the main body 30" for contactingly lifting and/or locking each of the pair of cover members 41", 43" to a flush position with or into engagement with upper peripheries of the main body 30". The pair of cover lifters and/or locks 48, 49 can be hydraulic cylinders, for example, which operational lift, as well as lower or disengage from, the pair of cover members 41", 43" when the pair of cover members 41", 43" positionally overlie the shelter mount or platform 50" to thereby flushly close and open the pair of cover members 41", 43".

As illustrated in this embodiment, the pair of cover members 41", 43" advantageously extend downward toward and into the inner chamber 35" of the main body 30" prior to being extended outwardly along the track 44*a*. Nevertheless, this alternative construction and mounting for the pair of cover members 41", 43" also advantageously extends outwardly and inwardly within the inner chamber 35" along a generally arcuate path during the respective raising and lowering of the platform 50".

Figure 10:
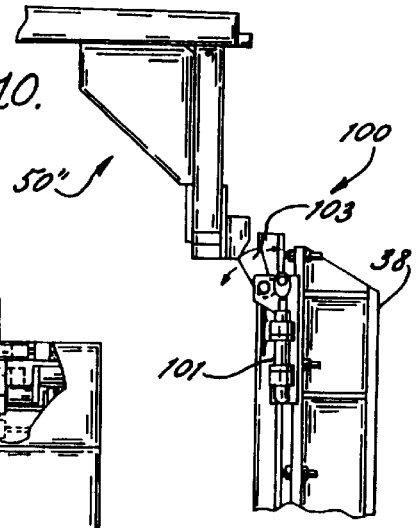
FIG. 10 is a fragmentary front elevational view of a shelter mount locking means of a sheltering apparatus taken along line 10—10 of FIG. 9 according to a third embodiment of the present invention.
Figure 11:
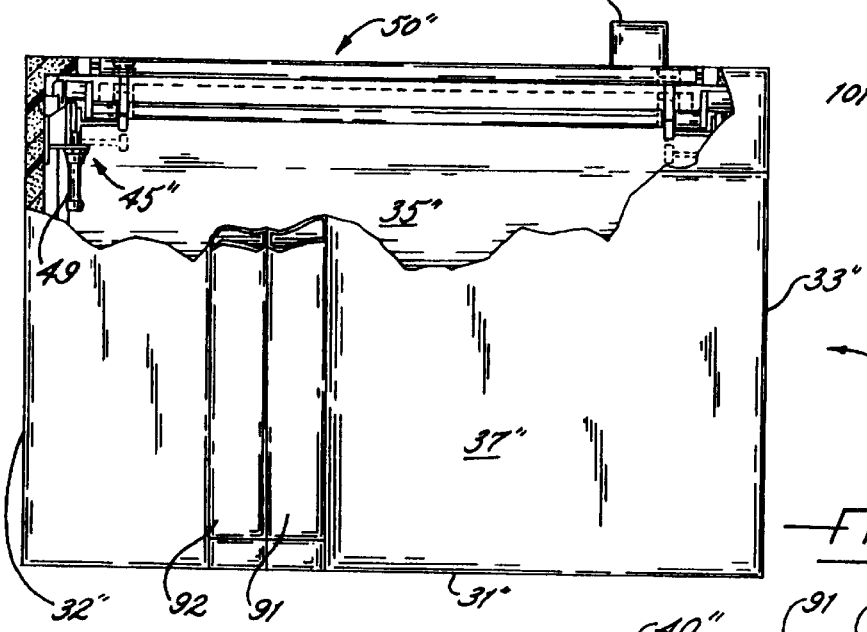
FIG. 11 is a left side elevational view of a sheltering apparatus having portions thereof broken away for clarity according to the present invention.
Figure 12:
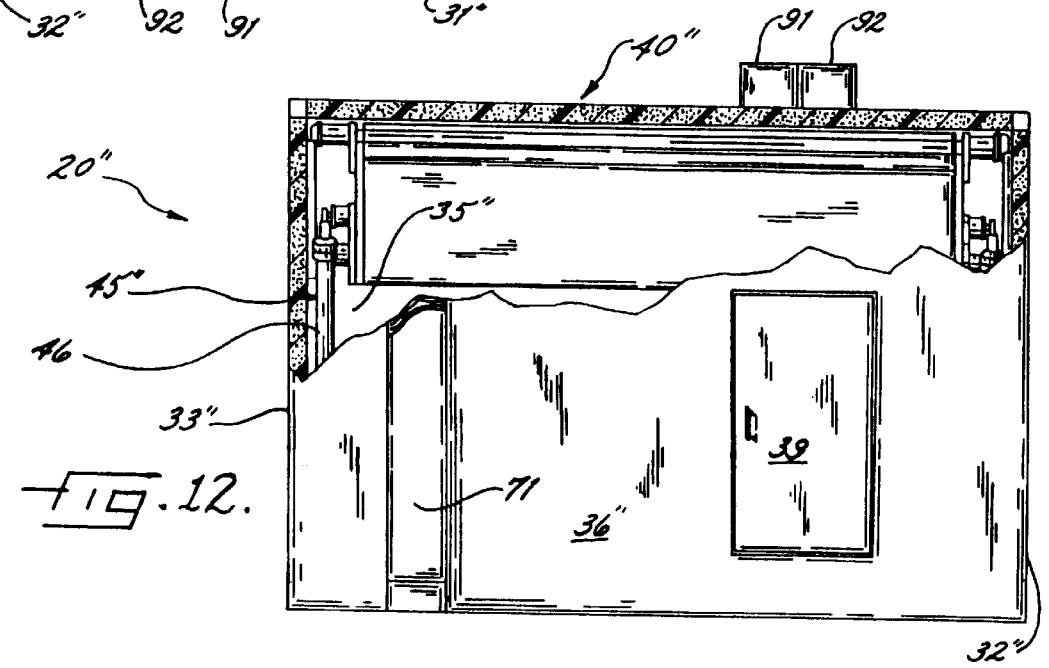
FIG. 12 is right side elevational view of a sheltering apparatus having cover members thereof in a retracted and closed position and having portions thereof broken away for clarity according to the present invention.

Also, as best illustrated in FIGS. 9–10, the shelter mount extending and retracting means 55" also includes shelter mount locking means 100 connected to the main body 30", e.g., via the structural support members 38 for the shelter mount tracks 56*a*, for locking the shelter mount or platform 50" into a raised or extended position. The shelter mount locking means 100 preferably includes a plurality of hydraulic cylinder 101 mounted to the plurality of support members 38 and a plurality of locking arms 103 each pivotally connected to a respective one of the plurality of hydraulic cylinders 101. As best illustrated in FIG. 10, the locking arms 103 preferably pivot outwardly and downwardly so as to abuttingly contact or engage lower peripheries of the shelter mount or platform 50" and thereby positionally hold or lock the platform 50" into the raise or extended position.

As illustrated in FIGS. 1–12, the present invention also includes methods of sheltering devices P. A method according to the present invention preferably includes opening an inner chamber cover 41, 43 which covers an inner chamber 35 of a main body 30 and upwardly extending a sheltered device P positioned within the inner chamber 35 of the main body 30 simultaneously with the opening of the inner chamber cover 41, 43 to thereby position the sheltered device P for operational use.

This method can also include closing the inner chamber cover 41, 43 and downwardly retracting the sheltered device P responsive to the closing of the inner chamber cover 41, 43 to thereby position the sheltered device P for sheltering thereof. The steps of opening and closing the inner chamber cover 41, 43 preferably include extending and retracting the inner chamber cover 41, 43 in a generally arcuately-shaped path and respectively extending and retracting the sheltered device P along a generally vertical path through the inner chamber cover 41, 43. The sheltered device P can also advantageously be positioned to a selected operational position when the inner chamber cover 41, 43 is in the open position (see, e.g., FIG. 5).

Another method of sheltering devices P according to the present invention preferably includes providing a main body 30 having a bottom 31, a plurality of walls 32, 33, 36, 37 connected to and extending upwardly from the bottom 31, and an inner chamber 35 defined by the inner confines of the bottom 31 and the plurality of walls 32, 33, 36, 37. A pair of inner chamber cover members 41, 43 is provided which is connected to the main body 30 to cover the inner chamber 35 of the main body 30 when in a closed position and to access the inner chamber 35 when in an open position. A device P to be sheltered is mounted to a sheltered device mount 50 positioned within the inner chamber 35 when the pair of inner chamber cover members 41, 43 are in the closed position. The sheltered device mount 50 is extended upwardly from the bottom 31 simultaneous with the opening of the pair of inner chamber cover members 41, 43 to thereby position the sheltered device mount 50 for operational use. The sheltered device mount 50 is also retracted downwardly toward the bottom 31 simultaneous with the closing of the pair of inner chamber cover members 41, 43 to thereby position the sheltered device mount 50 for sheltering of the device P mounted thereto.

This method can also include extending each of the pair of cover members 41, 43 outwardly and downwardly to the open position and retracting each of the pair of cover members 41, 43 upwardly and inwardly to the closed position. The steps of extending and retracting the pair of inner chamber cover members 41, 43 preferably includes extending and retracting the pair of cover members 41, 43 in a generally arcuately-shaped path and extending the sheltered device mount 50 upwardly above upper peripheries of each of the pair of cover members 41, 43 to the operational use position when the pair of cover members 41, 43 is in the open position. This extending and retracting of the sheltered device P can further include respectively extending and retracting the sheltered device mount 50 along a generally vertical path through the open pair of cover members 41, 43. The sheltered device mount 50 or the sheltered device(s) P can also be rotated and/or tilted to a selected position for operational use of the sheltered device(s) P (see, e.g., FIG. 5).

This method can further include controlling the temperature of the inner chamber 35 of the main body 30 during various environmental conditions and sensing a predetermined command signal transmitted from a source remote to the main body 30 to thereby responsively open and close the pair of inner chamber cover members 41, 43 and thereby responsively raise and lower the sheltered device(s) P of use thereof.

A further method of sheltering devices P according to the present invention preferably includes opening a pair of inner chamber cover members 41, 43 which cover an inner chamber 35 of a main body 30 and upwardly extending a sheltered device mount 50 positioned within the inner chamber 35 of the main body 30 simultaneous with and responsive to the opening of the pair of inner chamber cover members 41, 43 to thereby position the sheltered device mount 50 for operational use. The pair of inner chamber cover members 41, 43 can also be closed, and the sheltered device mount 50 is downwardly retracted simultaneous with and responsive to the closing of the pair of inner chamber cover members 41, 43 to thereby position the sheltered device mount 50 for sheltering of the device P mounted thereto. The other method steps as described above can also advantageously be included in this method according to the present invention, and particularly in relation to the pair of cover members 41, 43 as illustrated and described herein.

As illustrated and described, the present invention advantageously provides an apparatus 20, 20', 20" and methods for sheltering devices P for quick and repetitive operational use. The apparatus 20 and methods also advantageously provide effective control of operational timing for opening and closing a cover 41, 43 of the sheltering apparatus 20, 20', 20" such as for launching projectiles P or operating a radar tracking device. The apparatus 20, 20', 20" and methods according to the present invention additionally provide effective operational control of the positioning of the projectiles, weapons, tracking (see FIG. 6) or other devices P which are mounted within the inner chamber 35 of the sheltering apparatus 20, 20', 20" for launching or movement required by the operational use desired.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. A sheltering apparatus comprising:

a main body having a bottom, a plurality of walls connected to and extending upwardly from said bottom, and an inner chamber defined by the inner confines of said bottom and said plurality of walls;

inner chamber covering and accessing means connected to said main body for covering the inner chamber of said main body when in a closed position and for accessing the inner chamber when in an open position;

sheltered device mounting means positioned in the inner chamber and connected to said main body for mounting a device to be sheltered thereto; and sheltered device mount extending and retracting means connected to said sheltered device mounting means for extending said sheltered device mounting means upwardly from said bottom simultaneous with the opening of said inner chamber covering and accessing means to thereby position said sheltered device mounting means for operational use and retracting said sheltered device mounting means downwardly toward said bottom simultaneous with the closing of said inner chamber covering and accessing means to thereby position said sheltered device mounting means for sheltering.

2. An apparatus as defined in claim 1, wherein said inner chamber covering and accessing means includes a pair of cover members connected to said main body for covering and for accessing the upper end of the inner chamber and cover extending and retracting means connected to said pair of cover members for extending each of said pair of cover members outwardly and downwardly to the open position and for retracting each of said pair of cover members upwardly and inwardly to the closed position.

3. An apparatus as defined in claim 1, wherein said inner chamber covering and accessing means includes a pair of cover members connected to said main body for covering and for accessing the upper end of the inner chamber and cover extending and retracting means connected to said pair of cover members for extending each of said pair of cover members downwardly and outwardly to the open position and for retracting each of said pair of cover members inwardly and upwardly to the closed position.

4. An apparatus as defined in claim 2, wherein said sheltered device mount extending and retracting means extends said sheltered device mounting means upwardly above upper peripheries of each of said pair of cover members to the operational use position when said pair of cover members is in the open position.

5. An apparatus as defined in claim 2, wherein said cover extending and retracting means extends each of said pair of cover members outwardly and downwardly in a generally arcuately-shaped path.

6. An apparatus as defined in claim 2, wherein said sheltered device mount extending and retracting means extends and retracts said sheltered device mounting means upwardly from said bottom of said main body along a generally vertical path through the open pair of cover members.

7. An apparatus as defined in claim 2, wherein said plurality of walls includes at least a front wall and a rear wall, wherein each of said pair of cover members have a generally arcuate shape, wherein upper ends of each of said pair of cover members are positioned adjacent each other when in the closed position covering the inner chamber, and wherein lower ends of each of said pair of cover members extend below upper ends of the front and rear walls when said pair of cover members is in the closed position.

8. An apparatus as defined in claim 1, further comprising rotating means connected to said sheltered device mounting means for rotating said sheltered device mounting means to a selected position for operational use of the sheltered device.

9. An apparatus as defined in claim 1, further comprising temperature controlling means connected to said main body for controlling the temperature of the inner chamber of said main body during various environmental conditions.

10. An apparatus as defined in claim 1, further comprising remote command signal sensing means connected to said main body for sensing a predetermined command signal transmitted from a source remote to said main body to thereby responsively open and close said inner chamber covering and accessing means.

11. An apparatus as defined in claim 1, wherein the sheltered device comprises a plurality of missile projectiles.

12. An apparatus as defined in claim 1, wherein the sheltered device comprises a radar tracking device.

13. A sheltering apparatus comprising:

a main body having a bottom, a plurality of walls connected to and extending upwardly from said bottom, and an inner chamber defined by the inner confines of said bottom and said plurality of walls;

an inner chamber cover connected to said main body for covering the inner chamber of said main body when in a closed position and for accessing the inner chamber when in an open position, said inner chamber cover including a pair of cover members connected to said main body for covering and for accessing the upper end of the inner chamber and cover extending and retracting means connected to said pair of cover members for extending each of said pair of cover members outwardly and downwardly in a generally arcuate-shaped path to the open position and for retracting each of said pair of cover members upwardly and inwardly along the generally arcuate-shaped path to the closed position;

a sheltered device mounting platform positioned in the inner chamber and connected to said main body for mounting a device to be sheltered thereto; and a platform extender and retractor connected to said sheltered device mounting platform for extending said sheltered device mounting platform upwardly from said bottom along a generally vertical path through the open pair of cover members simultaneous with the opening of said pair of cover members to thereby position said sheltered device mounting platform for operational use and retracting said sheltered device mounting platform downwardly toward said bottom along the generally vertical path through the open pair of cover members simultaneous with the closing of said pair of cover members to thereby position said sheltered device mounting platform for sheltering the device mounted thereto.

14. An apparatus as defined in claim 13, wherein said platform extender and retractor extends said sheltered device mounting platform upwardly above upper peripheries of each of said pair of cover members to the operational use position when said pair of cover members is in the open position.

15. An apparatus as defined in claim 14, wherein said plurality of walls of said main body includes at least a front wall and a rear wall, wherein each of said pair of cover members have a generally arcuate shape, wherein upper ends of each of said pair of cover members are positioned adjacent each other when in the closed position covering the inner chamber, and wherein lower ends of each of said pair of cover members extend below upper ends of the front and rear walls when said pair of cover members is in the closed position.

16. An apparatus as defined in claim 15, further comprising rotating means connected to said sheltered device mounting platform for rotating said sheltered device mounting platform to a selected position for operational use of the sheltered device.

17. An apparatus as defined in claim 16, further comprising tilting means connected to said sheltered device mounting platform for tilting said sheltered device mounting platform to a selected position for operation use of the sheltered device.

18. An apparatus as defined in claim 17, further comprising a temperature controller connected to said main body for controlling the temperature of the inner chamber of said main body during various environmental conditions.

19. An apparatus as defined in claim 18, further comprising a remote command signal sensor connected to said main body for sensing a predetermined command signal transmitted from a source remote to said main body to thereby responsively open and close said pair of cover members.

20. An apparatus as defined in claim 19, wherein the sheltered device comprises a plurality of missile projectiles.

21. An apparatus as defined in claim 19, wherein the sheltered device comprises a radar tracking device.

22. A sheltering apparatus comprising:

a main body having a bottom, a plurality of walls connected to and extending upwardly from said bottom, and an inner chamber defined by the inner confines of said bottom and said plurality of walls;

inner chamber covering and accessing means connected to said main body for covering the inner chamber of said main body when in a closed position and for accessing the inner chamber when in an open position;

projectile mounting means positioned in the inner chamber and connected to said main body for mounting at least one projectile thereto; and projectile mount extending and retracting means connected to said projectile mounting means for extending said projectile mounting means upwardly from said bottom simultaneous with the opening of said inner chamber covering and accessing means to thereby position said projectile mounting means for launching and retracting said projectile mounting means downwardly toward said bottom simultaneous with the closing of said inner chamber covering and accessing means to thereby position said projectile mounting means for sheltering.

23. An apparatus as defined in claim 22, wherein said inner chamber covering and accessing means includes a pair of cover members connected to said main body for covering and for accessing the upper end of the inner chamber and cover extending and retracting means connected to said pair of cover members for extending each of said pair of cover members outwardly and downwardly to the open position and for retracting each of said pair of cover members upwardly and inwardly to the closed position.

24. An apparatus as defined in claim 22, wherein said inner chamber covering and accessing means includes a pair of cover members connected to said main body for covering and for accessing the upper end of the inner chamber and cover extending and retracting means connected to said pair of cover members for extending each of said pair of cover members downwardly and outwardly to the open position and for retracting each of said pair of cover members inwardly and upwardly to the closed position.

25. An apparatus as defined in claim 23, wherein said projectile mount extending and retracting means extends said projectile mounting means upwardly above upper peripheries of each of said pair of cover members to the launching position when said pair of cover members is in the open position.

26. An apparatus as defined in claim 25, wherein said cover extending and retracting means extends each of said pair of cover members outwardly and downwardly in a generally arcuately-shaped path.

27. An apparatus as defined in claim 26, wherein said projectile mount extending and retracting means extends and retracts said projectile mounting means upwardly from said bottom of said main body along a generally vertical path through the open pair of cover members.

28. An apparatus as defined in claim 27, wherein said plurality of walls includes at least a front wall and a rear wall, wherein each of said pair of cover members have a generally arcuate shape, wherein upper ends of each of said pair of cover members are positioned adjacent each other when in the closed position covering the inner chamber, and wherein lower ends of each of said pair of cover members extend below upper ends of the front and rear walls when said pair of cover members is in the closed position.

29. An apparatus as defined in claim 28, further comprising rotating means connected to said projectile mounting means for rotating said projectile mounting means to a selected position for launching the at least one projectile therefrom.

30. An apparatus as defined in claim 29, further comprising tilting means connected to said projectile mounting means for tilting said projectile mounting means to a selected position for launching of the at least one projectile.

31. An apparatus as defined in claim 30, further comprising temperature controlling means connected to said main body for controlling the temperature of the inner chamber of said main body during various environmental conditions.

32. An apparatus as defined in claim 31, further comprising remote command signal sensing means connected to said main body for sensing a predetermined command signal transmitted from a source remote to said main body to thereby responsively open and close said inner chamber covering and accessing means.

33. A method of sheltering devices, the method comprising:

providing a main body having a bottom, a plurality of walls connected to and extending upwardly from the bottom, and an inner chamber defined by the inner confines of the bottom and the plurality of walls;

providing a pair of inner chamber cover members connected to the main body to cover the inner chamber of the main body when in a closed position and to access the inner chamber when in an open position;

mounting a device to be sheltered to a sheltered device mount positioned within the inner chamber when the pair of inner chamber cover members are in the closed position; and extending the sheltered device mount upwardly from the bottom simultaneous with the opening of the pair of inner chamber cover members to thereby position the sheltered device mount for operational use; and retracting the sheltered device mount downwardly toward the bottom simultaneous with the closing of the pair of inner chamber cover members to thereby position the sheltered device mount for sheltering of the device mounted thereto.

34. A method as defined in claim 33, further comprising extending each of the pair of cover members outwardly and downwardly to the open position and retracting each of the pair of cover members upwardly and inwardly to the closed position.

35. A method as defined in claim 33, further comprising extending each of the pair of cover members downwardly and outwardly to the open position and retracting each of the pair of cover members inwardly and upwardly to the closed position.

36. A method as defined in claim 34, wherein the steps of extending and retracting the pair of inner chamber cover members includes extending and retracting the pair of cover members in a generally arcuately-shaped path.

37. A method as defined in claim 34, wherein the steps of extending and retracting the sheltered device mount includes the steps of extending the sheltered device mount upwardly above upper peripheries of each of the pair of cover members to the operational use position when the pair of cover members is in the open position.

38. A method as defined in claim 37, wherein the steps of extending and retracting the sheltered device mount further includes respectively extending and retracting the sheltered device mount along a generally vertical path through the open pair of cover members.

39. A method as defined in claim 34, further comprising rotating the sheltered device mount to a selected position for operational use of the sheltered device.

40. A method as defined in claim 34, further comprising tilting the sheltered device mount to a selected position for operational use of the sheltered device.

41. A method as defined in claim 34, further comprising controlling the temperature of the inner chamber of the main body during various environmental conditions.

42. A method as defined in claim 34, further comprising sensing a predetermined command signal transmitted from a source remote to the main body to thereby responsively open and close the pair of inner chamber cover members.

43. A method of sheltering devices, the method comprising:

opening a pair of inner chamber cover members which cover an inner chamber of a main body;

upwardly extending a sheltered device mount positioned within the inner chamber of the main body simultaneous with and responsive to the opening of the pair of inner chamber cover members to thereby position the sheltered device mount for operational use;

closing the pair of inner chamber cover members; and downwardly retracting the sheltered device mount simultaneous with and responsive to the closing of the pair of inner chamber cover members to thereby position the sheltered device mount for sheltering of the device mounted thereto.

44. A method as defined in claim 43, further comprising extending each of the pair of cover members outwardly and downwardly to the open position and retracting each of the pair of cover members upwardly and inwardly to the closed position.

45. A method as defined in claim 43, further comprising extending each of the pair of cover members downwardly and outwardly to the open position and retracting each of the pair of cover members inwardly and upwardly to the closed position.

46. A method as defined in claim 44, wherein the steps of opening and closing the pair of inner chamber cover members includes extending and retracting the pair of cover members in a generally arcuately-shaped path.

47. A method as defined in claim 46, wherein the steps of extending and retracting the sheltered device mount includes the steps of extending the sheltered device mount upwardly above upper peripheries of each of the pair of cover members to the operational use position when the pair of cover members is in an open position.

48. A method as defined in claim 47, wherein the steps of extending and retracting the sheltered device mount further includes respectively extending and retracting the sheltered device mount along a generally vertical path through the open pair of cover members.

49. A method as defined in claim 48, further comprising rotating the sheltered device mount to a selected position for operational use of the sheltered device.

50. A method as defined in claim 49, further comprising tilting the sheltered device mount to a selected position for operational use of the sheltered device.

51. A method as defined in claim 50, further comprising controlling the temperature of the inner chamber of the main body during various environmental conditions.

52. A method as defined in claim 51, further comprising sensing a predetermined command signal transmitted from a source remote to the main body to thereby responsively open and close the pair of inner chamber cover members.

53. A method of sheltering devices, the method comprising:

opening an inner chamber cover which covers an inner chamber of a main body; and upwardly extending a sheltered device positioned within the inner chamber of the main body simultaneously with the opening of the inner chamber cover to thereby position the sheltered device for operational use.

54. A method as defined in claim 53, further comprising closing the inner chamber cover and downwardly retracting the sheltered device responsive to the closing of the inner chamber cover to thereby position the sheltered device for sheltering of the device.

55. A method as defined in claim 54, wherein the steps of opening and closing the inner chamber cover includes extending and retracting the inner chamber cover in a generally arcuately-shaped path.

56. A method as defined in claim 55, wherein the steps of extending and retracting the sheltered device further includes respectively extending and retracting the sheltered device along a generally vertical path through the inner chamber cover.

57. A method as defined in claim 56, further comprising positioning the sheltered device to a selected operational position when the inner chamber cover is in the open position.

* * * * *